United States Patent [19]

Bruce

[11] Patent Number: 5,024,178

[45] Date of Patent: Jun. 18, 1991

[54] UNDERWATER PROPULSION DEVICE

[76] Inventor: Martin G. Bruce, Box 20011, #4-9764-5th St., Sidney, B.C., Canada, V8L 5C9

[21] Appl. No.: 479,884

[22] Filed: Feb. 14, 1990

[51] Int. Cl.[5] ..... B63C 11/46

[52] U.S. Cl. ..... 114/315; 440/6

[58] Field of Search ..... 114/242, 244, 315, 337, 114/338; 440/6, 7, 5

[56] References Cited

U.S. PATENT DOCUMENTS

| | | | |
|---|---|---|---|
| 3,916,814 | 11/1975 | Bardon et al. | 114/315 |
| 3,995,578 | 12/1976 | McCullough | 114/315 |
| 4,467,742 | 8/1984 | DuBoy | 114/315 |
| 4,700,654 | 10/1987 | Borges | 440/6 |
| 4,813,367 | 3/1989 | Stevenson | 114/315 |

OTHER PUBLICATIONS

Article "Dacor's Sea Sprint"-Eric Hanauer Skin Diver—Jun. 1988.

*Primary Examiner*—Joseph F. Peters, Jr.
*Assistant Examiner*—Jesûs D. Sotelo
*Attorney, Agent, or Firm*—Townsend and Townsend

[57] ABSTRACT

An underwater propulsion device for propelling a swimmer through the water has a hand held propulsion unit which permits the swimmer to move his hand and forearm to control direction of movement in the water. This allows superior maneuverability in the water. The device includes in combination, a power unit for attachment to the body of a swimmer, the power unit containing a power supply and a sealed motor; a propulsion unit having a propeller within a cylindrical housing, a hand grip on the outside of the housing for a swimmer to hold, a strap on the housing behind the hand grip to fit over a forearm of a swimmer to support the propulsion unit from the forearm. The handgrip has operating controls thereon the the motor. A flexible drive extends from the motor in the power unit to the propeller in the propulsion unit.

10 Claims, 1 Drawing Sheet

UNDERWATER PROPULSION DEVICE

TECHNICAL FIELD

The present invention relates to a device for propelling a swimmer through the water, and more specifically to a propulsion device which has a power unit for mounting on the body of a swimmer and a propulsion unit for attachment to a swimmer's arm.

BACKGROUND ART

There is a demand for a propulsion unit to be used underwater by swimmers, specifically those snorkeling or scuba diving. The term "swimmer" used herein includes surface swimmers, and underwater swimmers, often referred to as divers. Propulsion units are also used by lifeguards, and certain handicapped or disabled people. There is also a need for such units by the military. Some of these devices include sleds which are power operated, other include back packs wherein a propulsion unit is attached to the back of a swimmer. A typical example of a sled is shown in U.S. Pat. No. 4,813,367 to Stevenson. Examples of propulsion devices for mounting on the back of a swimmer are shown in U.S. Pat. No. 3,916,814 to Bardoni et al, in U.S. Pat. No. 3,995,578 to McCullough, and in U.S. Pat. No. 4,467,742 to Duboy.

Most motorized sleds are fairly large units and require a swimmer to mount the sled and drive it as a separate vehicle. The back powered units are sufficiently compact that they remain with the swimmer. In some cases, however, the back powered units extend for some distance out from the divers air bottle and thus are bulky. The units are awkward for a diver to enter and leave the water. Furthermore, these units are not easy for a swimmer to maneuver in the water because the propulsion unit is always fixed to the swimmer.

DISCLOSURE OF INVENTION

It is an aim of the present invention to provide an underwater propulsion device comprising a back mounted power unit connected by a flexible drive to a propulsion unit which is hand held and supported by an arm of a swimmer, thus providing good maneuverability for a swimmer in the water. It is a further aim to provide an underwater propulsion device which has a propulsion unit attached to the forearm of a swimmer that can be used by swimmers, life guards, snorkel divers, scuba divers and many other users. The arm supported propulsion unit can be moved in any direction and furthermore, the propulsion unit which comprises a propeller rotating within a cylindrical housing, can be reversed so a swimmer can move backwards. It allows sand to be washed away from an underwater archeological site. Because the propulsion unit is only attached to one arm, the swimmer's other arm is free for other purposes.

It is further aim of the present invention to provide an underwater device which is designed with neutral buoyancy. In another embodiment it is an aim to provide an adapter that attaches the power unit to a divers tank which has a quick release mechanism so that it can easily removed. The power unit comprises a series of battery cells that in one embodiment may be rechargeable, and it is a further aim to provide a unit that is small and does not interfere with a swimmer so that no problems occur when entering the water. By having the propulsion unit attached to the forearm, a swimmer is able to climb a ladder or the like when coming out of the water.

A still further aim is to provide a propulsion device that becomes part of a diver's gear, and is considered with the diver. The device does not require a diver to use body english when moving in the water.

The present invention provides an underwater propulsion device for a swimmer comprising a power unit adapted to be attached to the body of a swimmer, the power unit containing a power supply and a sealed motor, a propulsion unit having a propeller within a substantially cylindrical housing, hand grip means on the outside of the housing adapted to be held by the swimmer, strap means on the housing behind the hand grip means adapted to fit over a forearm of the swimmer to support the propulsion unit from the forearm, the handgrip means having operating controls thereon for the motor, and flexible drive extending from the motor in the power unit to the propeller in the propulsion unit.

BRIEF DESCRIPTION OF DRAWINGS

In drawings which illustrate embodiments of the present invention.

MODES FOR CARRYING OUT THE INVENTION

Figure 1:
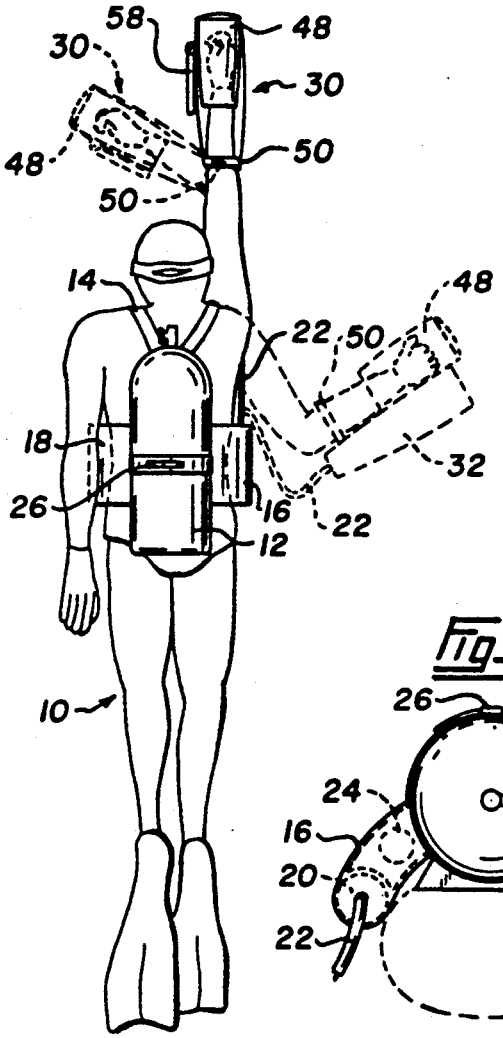
FIG. 1 is a top plan view showing a swimmer with an underwater propulsion device according to one embodiment of the present invention.
Figure 2:
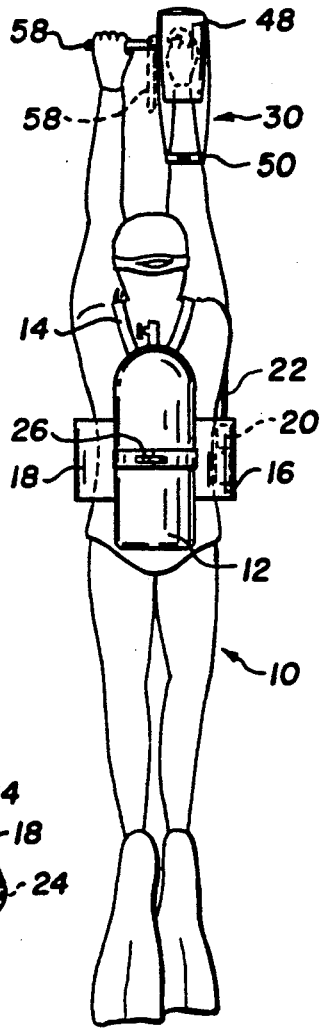
FIG. 2 is a top plan view showing a swimmer with the underwater propulsion device shown in FIG. 1 operated by two hands.
Figure 3:
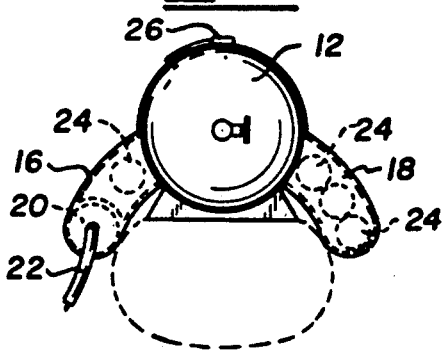
FIG. 3 is an end view showing an air tank with a power unit for the underwater propulsion device attached thereto.

A swimmer 10 is shown in FIGS. 1 and 2 has a scuba tank 12 on the back of the swimmer attached by a harness 14. Integral with the air tank 12 are two sections 16 and 18 which form the power unit for the underwater propulsion device of the present invention. The first section 16 has at its top a sealed motor 20 connected to a flexible drive 22 similar to a speedometer type of drive shaft wherein a flexible shaft rotates within a flexible cover. In another embodiment, the flexible drive shaft may have needle bearings spaced along the shaft, between a cover and the rotating shaft. The remaining space within the first section 16 of the power unit contains batteries 24, as shown in FIG. 3, and batteries are also included in the whole of the second section 18 of the power unit. The batteries are preferable of the rechargeable type although non-rechargeable alkaline batteries may be used, and the complete power unit is arranged to be clamped to the air bottle 12 and has a quick release lever 26 so that it may be easily attached and detached. This permits the power unit to be removed from empty air bottles and attached to full air bottles. It also permits the power unit to be removed so that the batteries may be recharged.

Whereas the drawings illustrate the power unit attached to the air bottle 12, the power unit may be attached to a belt or separate harness arrangement that permits a swimmer to use the propulsion unit without an air bottle.

Figure 4:
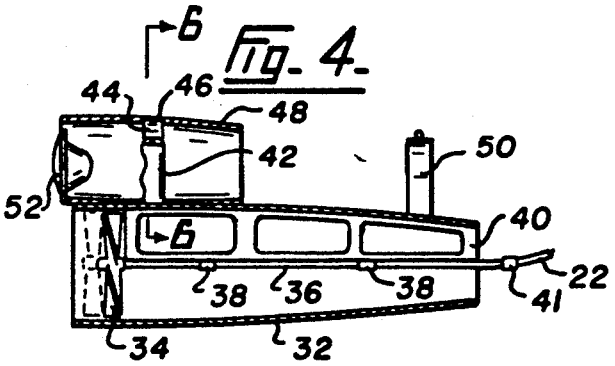
FIG. 4 is a sectional side view of the propulsion unit according to one embodiment of the propulsion device.
Figure 5:
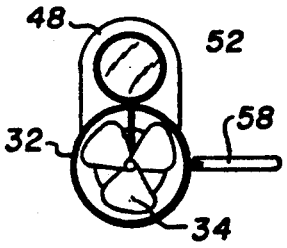
FIG. 5 is a front view of the propulsion unit shown in FIG. 4.

The propulsion unit 30 as shown in FIGS. 4 and 5, has a substantially cylindrical housing 32, which in the embodiment shown tapers towards the exit. A propeller 34 is positioned adjacent the front of the housing 32 mounted on a shaft 36 held by supports 38 attached to a bracket 40 which extends down from the interior wall of the housing 32. As shown in FIG. 4 the bracket 40 has a series of gaps therein so that it has minimum restriction to any rotation of water caused by the propeller 34.

The shaft 36 is connected by a coupling 41 to the flexible drive 22 which in turn is connected to the motor 20 in the power unit. On top of the housing 32 is a handle grip 42 to be gripped by the hand of a swimmer.

Figure 6:
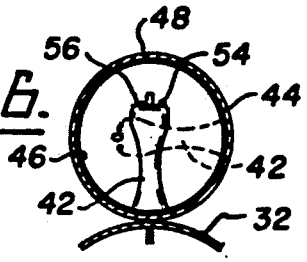
FIG. 6 is a sectional view of the control handle at line 6—6 of FIG. 4.

The handle grip 42 is supported in a ring 44, as shown in FIG. 6 which rotates in a circular groove 46 within a shroud or cover 48. A swimmer places his hand within the cover 48, and grips the handle grip 42. The grip 42 can be positioned perpendicular from the housing 32 or turned through about 90° as shown in dotted line in FIG. 6. Thus a swimmer can hold the grip 42 in either two positions.

An adjustable strap 50 is provided towards the end of the housing 32 to permit the forearm of a swimmer 10 to be inserted therethrough. A hose clamp type adjustment with a knurled knob that can be gripped by the other hand of the swimmer permits the strap 50 to be tightened on the forearm so that the propulsion unit 30 is held to the forearm. Rotation of the knurled knob in one direction, permits the strap 50 to be tightened, and rotation in the other direction loosens the strap so the arm can slip out. The manner in which the propulsion unit 30 is held is shown in FIGS. 1 and 2.

In one embodiment a light 52 is provided so that the swimmer can see where he is going underwater. The hand grip 42 has two thumb buttons 54, and 56. One button 54 is a speed control, from off to top speed and the other button 56 operates forward and reverse. Insulated waterproof electrical wires are integral with the flexible drive shaft 22 to the motor 20 in the power pack and furthermore other electrical wires from the light 52 to the batteries 24 are also integral with the flexible drive shaft 22. A switch (not shown) is provided adjacent the light so that the light can be turned on or off as desired.

In use, a swimmer inserts his arm through the strap 50 until his hand can reach the hand grip 42. The strap 50 is preferably made of flexible plastic or rubber, with adjustment for tightening on a forearm. When a swimmer comes out of the water and climbs a ladder he can release the hand grip 42, take his hand out of the shroud 47 and allow the propulsion unit 30 to dangle from his arm. In the water a separate handle 58 is provided at the side of the housing 32 and pivots out so that when a swimmer wishes to go for long runs he holds the propulsion unit with his right hand and also holds the separate handle 58 in his left hand, thus allowing him to hold the unit with two hands and form a stream lined position behind the propulsion unit 30. Normal maneuverability is achieved with one hand only.

A variable speed motor 20 is preferably provided and the speed switch 54 operates a rheostat, all of which is sealed for underwater use. The weight of the propulsion device including the propulsion unit, batteries, motor and flexible drive shaft is preferably about 15 pounds and is neutrally buoyant within the water. The weight of the complete propulsion device is approximately the same as the weight normally worn by a diver in a belt around the waist. This weight varies dependent upon the type of suit and equipment worn by the diver. In another embodiment added weights can be provided dependent on the requirement of specific swimmers or divers.

With the propulsion unit 30 attached to the underside of the forearm, a swimmer is able to move the unit in almost any direction, either to the left or to the right, up or down, thus providing excellent maneuverability in the water. Furthermore, by having the reversing switch 56 attached to the hand grip 42, a swimmer is able to position himself in almost any position with ease. In one embodiment the swimmer may take a vertical position within the water and move up or down by means of the propulsion unit 30, the swimmer always has one hand free of the propulsion unit, although on long runs, the swimmer may hold onto the handle 58.

The power unit attached to the air tank 12 can be moved up and down the tank for correct weight distribution. Once the desired position is reached then it can be marked on the tank to ensure that the clamp 26 always clamps the unit to the air tank 12 for a particular swimmer. By having the two sections 16 and 18 of the power pack close to the swimmer's body, then the weight does not cause the swimmer to roll in the water. Furthermore, because the unit does not form an obstacle extending out behind the air tank 12, there is no problem for a swimmer entering the water, he can jump in the normal manner holding the propulsion unit 30 in one hand.

In another embodiment the propeller may be a counter rotating propeller, thus no torque is provided from the propulsion unit 30. The counter rotating propeller is shown in dotted line in FIG. 4 and both propellers are driven by the flexible cable 22 with gearing within the hub to rotate the two propellers in opposite directions. In a still further embodiment the propeller hub may be turned by hand to vary the propeller pitch, thus providing different speeds for a swimmer.

In one embodiment batteries last up to eighty minutes if used sparingly. An air tank for a swimmer usually lasts for up to forty minutes, this would allow two dives without having to recharge the batteries. The propulsion unit 30 is preferably made out of plastic material and is light weight, therefore easy for a swimmer to move in the water and even out of the water. The flexible cable 22 as shown, extends under the arm and therefore does not cause an obstruction to the air hoses for the swimmer.

Various changes may be made to the embodiments shown herein without departing from the scope of the present invention which is limited only by the following claims.

The embodiments of the present invention in which an exclusive property or privilege is claimed are defined as follows:

1. An underwater propulsion device for a swimmer comprises in combination:

a power unit adapted to be attached to the body of a swimmer, the power unit containing a power supply and a sealed motor, a propulsion unit having a propeller within a substantially cylindrical housing, hand grip means on the outside of the housing adapted to be held by the swimmer, strap means on the housing behind the hand grip means adapted to fit over a forearm of the swimmer to support the propulsion unit from the forearm, the handgrip means having operating controls thereon for the motor, and flexible drive extending from the motor in the power unit to the propeller in the propulsion unit.

2. The underwater propulsion device according to claim 1 wherein the power unit, propulsion unit, and flexible drive have a neutral buoyancy in water.

3. The underwater propulsion device according to claim 1 wherein the hand grip means is mounted within a shroud attached to the outside of the housing.

4. The underwater propulsion device according to claim 1 including a light attached to the outside of the housing.

5. The underwater propulsion device according to claim 1 wherein the motor is a variable speed motor and the hand grip means includes controls for the variable speed motor.

6. The underwater propulsion device according to claim 1 wherein the hand grip means has a switch thereon to control forward and reverse direction of the propeller rotation.

7. The underwater propulsion device according to claim 1 wherein counter rotating propellers are provided within the cylindrical housing.

8. The underwater propulsion device according to claim 1 wherein the power unit is formed in two sections positioned on each side of a divers air tank.

9. The underwater propulsion device according to claim 8 including quick release means to attach the power unit to an air tank and release the power unit from the air tank.

10. The underwater propulsion device according to claim 1 including a side handle pivoted from the outside of the cylindrical housing adapted to be held by the swimmer's other hand.

* * * * *